United States Patent [19]

Kyvsgaard

[11] 3,955,902

[45] May 11, 1976

[54] FLEXIBLE TUBE PUMP

[76] Inventor: Erik Bach Kyvsgaard, 6, Melchiorsvej, 2920 Charlottenlund, Denmark

[22] Filed: May 28, 1974

[21] Appl. No.: 474,062

[30] Foreign Application Priority Data

May 29, 1973 Denmark ..... 2953/73
May 22, 1974 Denmark ..... 2787/74

[52] U.S. Cl. ..... 417/477
[51] Int. Cl.[2] ..... F04B 43/12
[58] Field of Search ..... 417/474–477, 429; 418/45

[56] References Cited

UNITED STATES PATENTS 3,180,272 4/1965 Broadfoot ..... 417/477
3,674,383 7/1972 Iles ..... 417/476

FOREIGN PATENTS OR APPLICATIONS 9,839 10/1853 France ..... 417/476
113,980 10/1941 Australia ..... 417/477
22,407 10/1898 United Kingdom ..... 417/477

*Primary Examiner*—Carlton R. Croyle
*Assistant Examiner*—O. T. Sessions
*Attorney, Agent, or Firm*—Harold L. Stowell

[57] ABSTRACT

Pump with a housing comprising an internal surface and a rotor with two opposite rollers compressing a flexible tube between the rollers and the internal surface, the internal surface being part of a cone and the rollers being truncated cones in order to provide adjustment means for the compression of the tube and to provide regulating means for the pump capacity independently of the rotational speed of the rotor.

8 Claims, 5 Drawing Figures

FLEXIBLE TUBE PUMP

The present invention relates to a pump of the type with a housing comprising an internal surface forming a half circle and a rotor with two oppositely arranged rollers, compressing a tube against the surface and in which the compressed part of the tube during the rotation of the rotor is moving along the tube.

Such pumps are known as peristaltic pumps.

Pumps of this kind are used in pumping of liquids under sterile conditions, as it is possible to place the pump in a suitable place in a tube without cutting the tube or in other ways interfere with the sterile conditions inside the flexible tube. In order to be able to provide a predetermined pump pressure without excessive compression of the flexible tube, it is important to adjust the position of the rollers in relation to the half-circular surface. Known pumps are provided with independent adjusting means for each of the rollers, which are cylindrical and which compress the tube against a cylindrical surface. The independent adjustment of the rollers with respect to the rotor makes it difficult during normal conditions to obtain the same adjustment for the two rollers.

Another disadvantage in known pumps of this type is that the part of the tubing which is placed in contact with the internal surface of the housing is displaced due to the action of the rollers. In known pumps means are necessitated in order to fix the tube both at the inlet and the outlet and often at points in between, which makes the insertion of the tube difficult.

An object for the present invention is to eliminate these disadvantages. According to the invention a pump is provided in which the insertion of the flexible tube is simplified and in which the adjustment of the compression — occlusion — is performed simultaneously for both rollers, and in which the design and construction of the pump is simple and reliable. This is obtained with the pump characterized by the features stated in claim 1.

Owing to the conical shape of the rollers and of the internal surface of the housing, adjustment may take place simply by axial movement of the housing or the rotor with the rollers. Further experiments have shown that the flexible tube automatically finds a stable position on the conical surface, making the fixing of the tube at the outlet unnecessary. This simplifies the construction, and the adjustment of the occlusion, when the dimension of the flexible tube is changed, is being performed by means of an axial movement of the rotor with respect to the housing. Therefore, only one of the rollers has to be individually adjustable.

With peristaltic pumps guide rollers are normally used to ensure correct placing of the tube on the half-circular face of the housing. These guide rollers are normally perpendicular with respect to the rollers. In the pump according to the present invention the tube is held in place only in direction of the opening of the conus and the axes of the guide rollers are perpendicular to the axis of the rotor. The use of only a single pair of guide rollers is simplifying the construction and the insertion of the flexible tube.

The pre-adjustment of the rollers on the rotor in the pump according to the invention is performed by adjustment of one of the rollers, which is axially adjustable with respect to the rotor. This adjustment will not change during the use of the pump.

The adjustment of the occlusion according to the invention is performed by means of central adjustment and securing means provided for adjustment of the axial adjustment of the rotor with respect to a drive pinion driven by means of a transmission, which is connected with the housing.

Pumps according to the invention are suitable for the pumping of blood in oxygenators for heart surgery. In such applications it is preferable to be able to change the pump capacity without the need of placing a flexible tube of a different dimension and without the need of changing the rotational speed of the rotor. Especially in cases where this speed is not constant, but subject to a rhythmical variation in order to produce a pulsation corresponding to the normal throb of the pulse of the patient.

It is an object of the invention to provide a pump with a variable capacity. This is obtained in a pump according to claim 7, in which guide rollers are placed in front of the conical rollers and in which the guide rollers are placed slidably on guides, which are substantially parallel with the half-circular surface of the housing in the area of the guide rollers, and the fixing means for the flexible tube having means for a corresponding movement.

With the pump according to the invention the change of capacity of easily seen and gives the operator a direct feeling of the pump capacity compared with for instance a variation in the number of revolutions of the rotor.

In a preferred embodiment the variation of capacity is possible during the operation of the pump. This is obtained in an arrangement in which the guide rollers have guide pins cooperating with an axially movable central control means, which is slidably mounted in a regulating head, which is supported from the housing.

Preferably, the regulating head is supported from one side in order to provide free access for insertion of the flexible tube. The support further may comprise a transmission by means of which the fixing means for the flexible tube are displaced synchronously with the displacement of guide rollers.

The pump according to the invention makes it possible to change the pump pressure, pump capacity and, if necessary, the throub of a pulse with simple, reliable mechanical means in a way corresponding to that of the human heart. If the rotor is driven by means of a transmission with a pulsating rotational speed, it is possible to vary the speed of the pulse by varying the rotational speed of the rotor. The pump capacity, which is proportional with the number of revolutions may further be changed by moving the guide rollers and fixing means along the half-circular surface. Finally, the occlusion of the flexible tube may be adjusted by an axial displacement of the rotor in order to change the pump pressure.

In order to obtain an adequate regulation capacity it is preferred that the tapering angle of the internal surface is big, preferably within the area of 30° – 120°. In a preferred embodiment, the angle is 90°.

A more complete description of the invention is given below with reference to accompanying drawings, in which.

Figure 1:
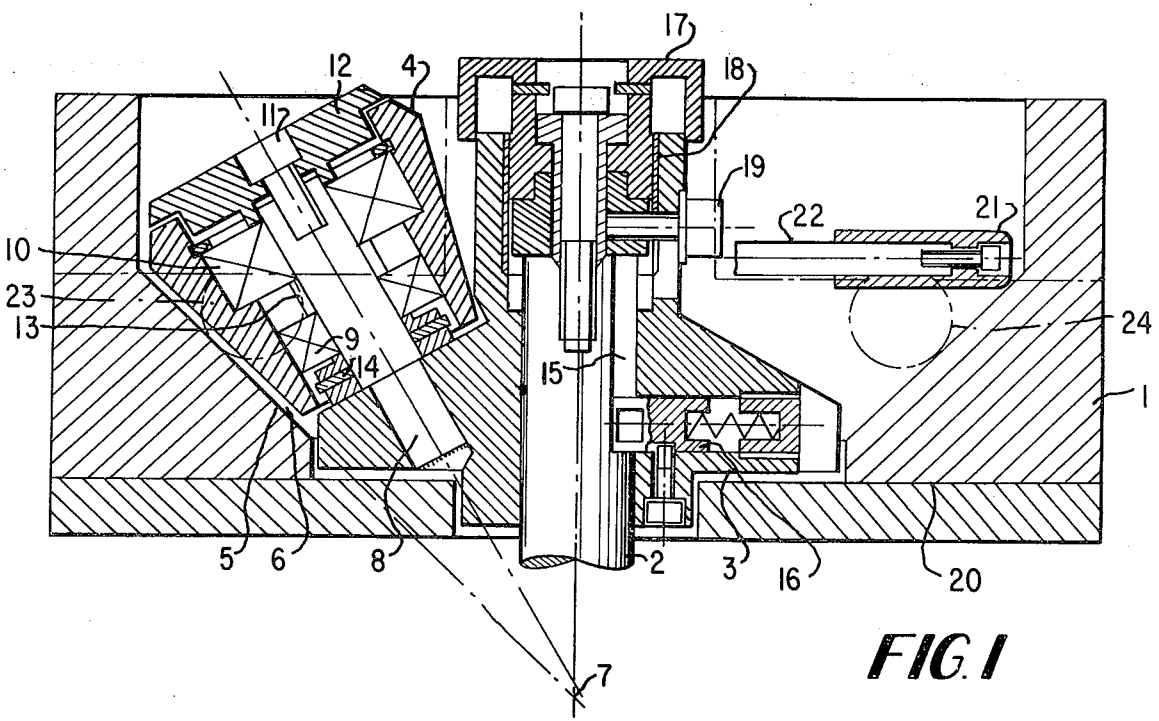
FIG. 1 shows an axial section through a pump according to the invention.

The pump shown in FIG. 1 comprises a housing 1, connected with driving means (not shown) which may comprise an electric motor with a reduction gear with a driving shaft 2, on which is placed a rotor 3. On the rotor 3 two rollers 4 are mounted oppositely with respect to the axis of the driving shaft. Between each of the rollers 4 and a surface 5 in the housing a space 6 is provided in which a flexible tube may be inserted and compressed. During the rotation of the rotor 3 the place of compression is displaced along the flexible tube, whereby the contents of liquid in the flexible tube is pumped through the flexible tube with the speed of the rollers.

The surface 5 is part of a cone, and the rollers too have the shape of a truncated cone with their vertices placed in the area of the vertex 7 of the conical surface 5. The rollers 4 are mounted on a shaft 8, the axis of which passes close to the point 7. The rollers are mounted on two ball-bearings 9 and 10. The adjustment of the rollers with respect to the surface 5 is performed by means of a screw 11, the head of which presses against a top plate 12, supported on the inner ring of the ball-bearing 10, a bushing 13 and the ball-bearing 9, which is supported by means of a resilient distance member 14, f. ex. a number of disc rings. It is only necessary to adjust one of the rollers 4 and the distance member of the other roller therefore may be stationary.

The drive shaft 2 has an axial groove 15, into which a pin 16 is inserted. The pin is mounted in a radial bore and is spring-loaded in direction of the groove 15. One side of the groove 15 is cut away in order to provide an over-running clutch.

The axial adjustment of the rotor is performed by means of a central hand wheel 17, provided with an internal thread 18 cooperating with an internal thread in the rotor 3. A locking screw 19 prevents unintentional turning of the hand wheel 17.

Figure 3:
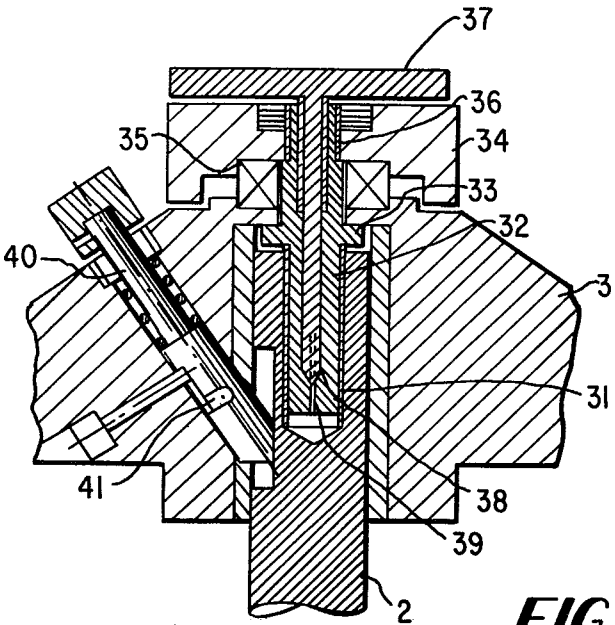
FIG. 3 is an axial section between an embodiment of the adjusting means for the axial displacement of the rotor.

Another arrangment of the adjustment is shown in FIG. 3, in which the drive shaft is provided with an internal thread 31, in which an adjustment screw 32 is mounted. The adjustment screw has a shoulder 33, against which the rotor 3 is resting. Between the rotor 3 and a hand wheel 34 an axial ball-bearing is placed, transferring the axial pressure from the rollers 4 (FIG. 1). A locking screw 37 is mounted in an axial bore 36 with an internal thread pressing with its pointed end 38 against the bottom of the bore 36 in the end of the adjusting screw which is provided with a slot 39. The rotor 3 has a spring-loaded pin 40, which is provided with an angled groove 41, cooperating with a locking screw. By pulling out the locking pin and turning it 90° it is brought out of contact with the drive shaft 2. Now it is possible to turn the rotor by hand for bleeding the tubes or in case of emergency.

Adjustment of the occlusion may be arranged in a section 20 between the housing 1 and the driving transmission. The adjustment means may comprise a wedge and may serve as an emergency stop relieving the pressure between the rollers 4 and the surface 5, or serve as adjustment of the occlusion in case this is desired during operation of the pump. The pump pressure may be regulated by adjusting the occlusion.

For guiding the tube in the gap 6 between the surface 5 and the roller 4 a guide roller 21 is mounted in front of each of the rollers on a radial arm 22.

Figure 2:
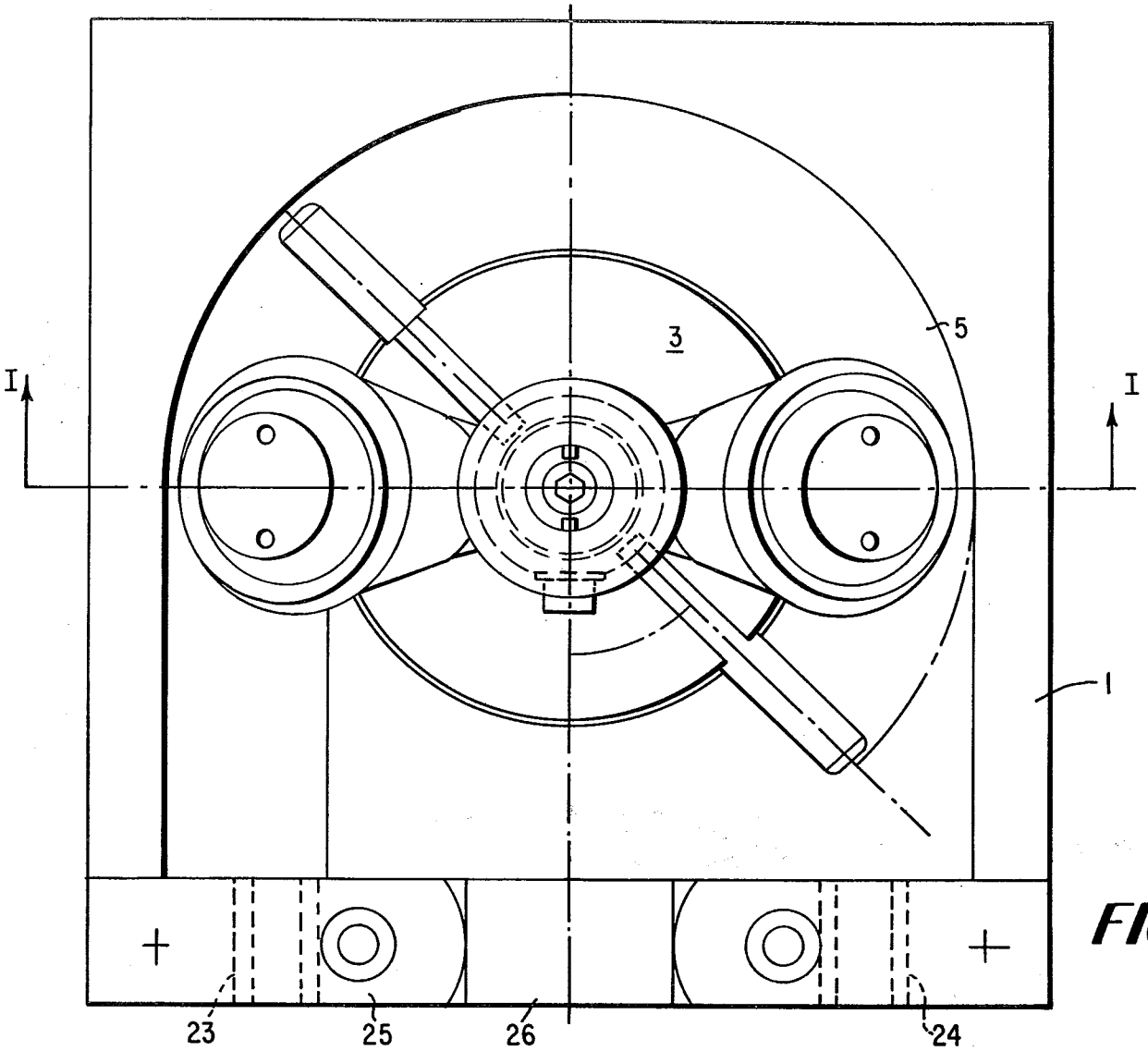
FIG. 2 shows the pump according to FIG. 1 viewed from above.

In FIG. 2 the pump is viewed from above. The flexible tube is inserted through two grooves 23, 24 in the housing 1 and at least in the inlet a clip 25 is provided for fixing the tube. The clips are of the conventional type and are normally placed in a separate part 26 of the house which is bolted or glued to the housing 1.

Figure 4:
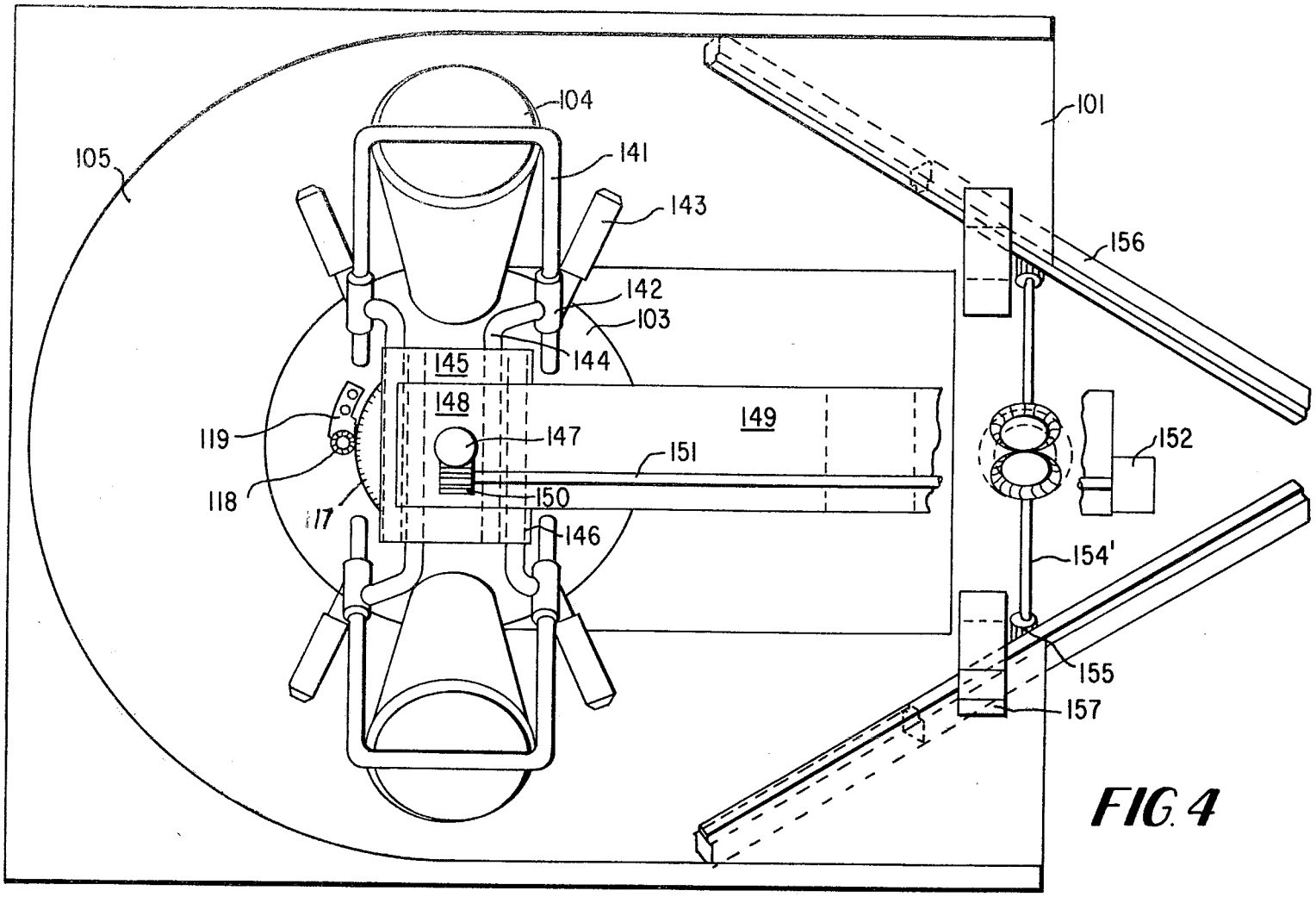
FIG. 4 shows a pump with variable capacity viewed from above with the support of the regulating head partly removed.
Figure 5:
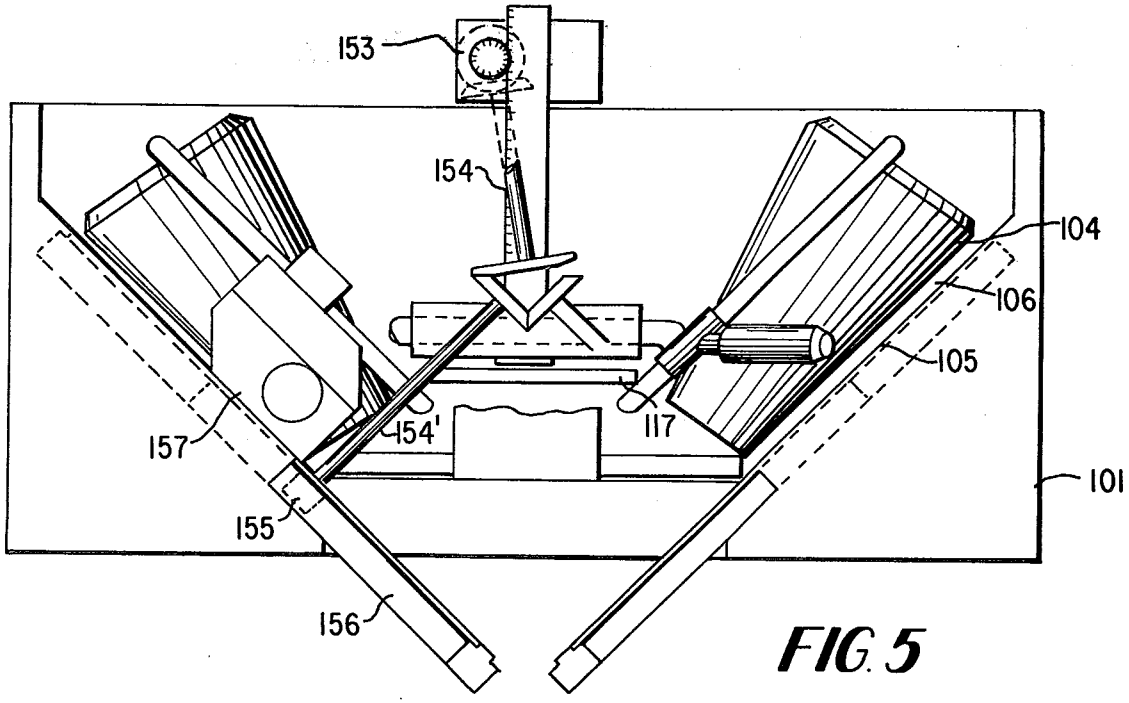
FIG. 5 shows the pump according to FIG. 4 viewed from the end opposite the half-circular surface, partly in section.

The pump shown in FIG. 4 comprises a housing 101, which is cooperating with a rotor 103. The rotor comprises two conical rollers 104, which roll along a half-circular, conical surface 105 with a clearance 106. The size of this clearance is such that a flexible tube inserted between the surface 105 and the roller 104 is compressed, the tube being closed in order to prevent passage of liquid through the compressed part of the tube. The rotor is driven from a (not shown) motor placed underneath the housing. A gear motor with a screw and worm transmission is suitable or a motor with a transmission providing a pulsating variation in rotational speed.

The rotor is provided with an adjusting wheel 117, provided with a tooth gearing. When the wheel 117 is turned in order to adjust the rotor axially by means of a key provided with a gear pinion which is inserted in a hole 118, depressing a locking spring 119 thereby releasing the adjusting wheel 117. When the key is removed, the adjusting wheel will be locked by means of the locking spring engaging the gear teeth of the adjusting wheel.

On both sides of each of the two rollers guides 141 are placed, on which guides bushings 142 each carrying a guide roller 143 are slidably mounted. On each bushing 142 is further mounted a guide pin 144, cooperating with central control means 145, having four borings 146, in which four guide pins are inserted. In the embodiment according to FIG. 4 the four borings are parallel, which implies that the four guide rollers will have a parallel displacement. In an intermediate position the guide rollers are rotated geometrically correct, but with a small angle of error in the inner and outer positions. The forces acting on the rollers 143 are comparatively small and therefore this angle of error only implies a limited wear on the tube, which under normal conditions is tolerable. If this wear cannot be accepted, both guides 141 and guide pins 144 are to be placed in the planes defined by the axis of the guide rollers and the rotor, or parallel to such planes.

In the control means 145 a central bearing is placed, f. ex. a ball-bearing, allowing the control means to rotate freely with the rotor 103. A regulating rod 147 is mounted in the inner part of the bearing and is slidably mounted in a regulating head 148, which is supported above the housing 101. The support may comprise an arm 149 (which is partly cut away in the drawing for illustrative reasons) said arm extending from one side of the pump housing from a point opposite the half-circular surface 102. This arm therefore gives free access for insertion of a tube. In the regulating head 148 the regulating rod is slidable by means of a rack and pinion drive. The pinion 150 is placed on a shaft 151, the opposite end of which carries a handwheel 152. The shaft carries a second drive 153 driving a conical gear transferring the rotation to an intermediate shaft 154. The intermediate shaft 154 drives by means of conical gears two further shafts with pinions engaging racks 156 on which the fixing means 157 for the tube is placed. By turning the handwheel 152 a simultaneous displacement of the control means 145 and the fixing means 157 will take place, and a tube placed in the pump therefore will displace radially outwards or inwards on the surface 105. The capacity of the pump will vary correspondingly.

In the illustrated embodiment the transmission of the movement of the regulating head to the corresponding movement of the fixing means for the tubes performed by mechanical means such as gears, shafts, and racks. Within the scope of the invention this transmission may be carried out in other ways such as by means of Bowden-wires or hydraulic means for transmission of these movements.

The fixing means 157 are guided in tracks with such a direction that the length of tube placed in the pump always is correct. The fixing means at the outlet is not necessary for the functioning of the pump, but prevent influence from a pull from the outside on the position of the tube in the pump.

I claim:

1. Pump with a housing comprising an internal surface forming at least a half circle and a rotor with two oppositely arranged rollers comprising a flexible tube against the surface and in which the compressed part of the tube during the rotation of the rotor is moving along the tube, wherein the half-circular surface is part of a cone, the rollers being truncated cones having their vertices in the area of the vertex of the internal surface, wherein the tapering angle of the cone of the internal surface is 30° – 120°; wherein at least one of the rollers is axially adjustable with respect to the rotor and the rotor comprises control adjusting means for axial movement of the rotor with respect to the housing.

2. Pump according to claim 1, wherein the tapering angle of the cone of the internal surface is 90°.

3. Pump with a housing comprising an internal surface forming at least a half circle and a rotor with two oppositely arranged rollers compressing a flexible tube against the surface and in which the compressed part of the tube during the rotation of the rotor is moving along the tube, wherein the half-circular surface is part of a cone, the rollers being truncated cones having their vertices in the area of the vertex of the internal surface, further wherein the rotor comprises control adjusting means for axial movement of the rotor with respect to the housing, wherein the adjusting means is characterized by a drive shaft for the rotor, said drive shaft having a central bore with an internal thread and adjustment screw provided with a slotted end mounted in the central bore of the drive shaft, the adjustment screw having a central bore with an internal thread, a pointed locking screw mounted in said central bore in the adjustment screw and pressing against the bottom of the bore of the adjusting screw.

4. Pump with a housing comprising an internal surface forming at least a half circle and a rotor with two oppositely arranged rollers compressing a flexible tube against the surface and in which the compressed part of the tube during the rotation of the rotor is moving along the tube, wherein the half-circular surface is part of a cone, the rollers being truncated cones having their vertices in the area of the vertex of the internal surface, guide rollers for axial positioning of the tube, said guide rollers being mounted at the side of the tube opposite to the vertex of the internal surface, wherein the guide rollers are slidably mounted on guides substantially parallel to the internal surface in an axial plane through the guide rollers and wherein fixing clips for the tube are slidably mounted with respect to the internal surface.

5. Pump according to claim 4, wherein the guide rollers are movable during the operation of the pump.

6. Pump according to claim 5, wherein the guide rollers are provided with guide pins cooperating with central control means mounted slidably movable in a regulating head supported centrally above the rotor.

7. Pump according to claim 6, wherein the regulating head is supported by means of an arm extending from a part of the housing opposite the internal, half-circular surface.

8. Pump according to claim 7, wherein the movement of the control means is synchronized with the movement of the fixing clips for the flexible tube.

* * * * *